US011465888B2

(12) United States Patent
Laidler

(10) Patent No.: US 11,465,888 B2
(45) Date of Patent: Oct. 11, 2022

(54) SYSTEM FOR A VEHICLE WITH A DETACHABLE HOIST

(71) Applicant: Jason Laidler, Pefferlaw (CA)

(72) Inventor: Jason Laidler, Pefferlaw (CA)

( * ) Notice: Subject to any disclaimer, the term of this patent is extended or adjusted under 35 U.S.C. 154(b) by 0 days.

(21) Appl. No.: 17/073,950

(22) Filed: Oct. 19, 2020

(65) Prior Publication Data

US 2022/0119230 A1 Apr. 21, 2022

(51) Int. Cl.
*B66C 23/44* (2006.01)

(52) U.S. Cl.
CPC ..... *B66C 23/44* (2013.01); *B66C 2700/0378* (2013.01)

(58) Field of Classification Search
CPC ..... B66C 23/44; B66C 2700/0378
See application file for complete search history.

(56) References Cited

U.S. PATENT DOCUMENTS 7,575,120 B2 8/2009 Beatty
8,231,325 B1 7/2012 Walton
9,283,130 B2 * 3/2016 Walker ..... A61G 3/062
10,123,527 B1 * 11/2018 Leger, Sr. ..... B66D 3/26
10,343,581 B1 * 7/2019 Leonard ..... B60P 1/5476
11,186,467 B2 * 11/2021 Backes ..... B66C 23/76
2015/0225212 A1 * 8/2015 Avila ..... B66C 23/365 414/800
2018/0118081 A1 * 5/2018 Jaeger ..... B66C 23/44
2019/0033158 A1 * 1/2019 Bonnet ..... B66C 23/44

* cited by examiner

*Primary Examiner* — Saul Rodriguez
*Assistant Examiner* — Ashley K Romano
(74) *Attorney, Agent, or Firm* — Sanchelima & Associates, P.A.; Christian Sanchelima; Jesus Sanchelima

(57) ABSTRACT

A lifting system for a vehicle including a powered winch, a telescopic hoist, jib, or arm and an attachment means on the vehicle for allowing the hoist arm to be pivotally adjusted. The attachment means is provided as a mounting plate which is mounted beneath the vehicle. The mounting plate includes receiving sections that receive a bottom distal end of the telescopic hoist arm. The hoist arm then upwardly extends from the bottom of the mounting plate and is supported to the vehicle using straps. Furthermore, the winch is provided as an integral part of the vehicle which is then fed through to the hoist arm an received by a pulley member located on a distal top end of the hoist arm. The winch is then secured to an anchor which is adapted to receive a load to be transported by the lifting system.

7 Claims, 6 Drawing Sheets

SYSTEM FOR A VEHICLE WITH A DETACHABLE HOIST

BACKGROUND OF THE INVENTION

1. Field of the Invention

The present invention relates to a detachable hoist system and, more particularly, to a system for a vehicle with a detachable hoist that includes a powered winch, a telescopic hoist arm, and an attachment means for securing the telescopic hoist to the vehicle.

2. Description of the Related Art

Several designs for a detachable hoist for a vehicle have been designed in the past. None of them, however, include a lifting system for a vehicle comprising a powered winch, a telescopic hoist, jib, or arm and an attachment means on the vehicle for allowing the hoist arm to be pivotally adjusted. The attachment means is provided as a mounting plate which is mounted beneath the vehicle. The mounting plate includes receiving sections that receive a bottom distal end of the telescopic hoist arm. The hoist arm then upwardly extends from the bottom of the mounting plate and is supported to the vehicle using straps. Furthermore, the winch is provided as an integral part of the vehicle which is then fed through to the hoist arm an received by a pulley member located on a distal top end of the hoist arm. The winch is then secured to an anchor which is adapted to receive a load to be transported by the lifting system. It is known that individuals often have the need to transport heavy objects that are located in their yard areas or outdoor environments. The process of transporting these objects can be a difficult and expensive process requiring the need specialized equipment. Therefore, there is a need for a lifting system to allow users to easily maneuver heavy objects without the need of expensive equipment or additional help.

Applicant believes that a related reference corresponds to U.S. Pat. No. 8,231,325 issued for a deer loader having a winch and an adjustable arm. Applicant believes that another related reference corresponds to U.S. Pat. No. 7,575,120 issued for a hoist that is demountably secured to a frame of an all-terrain vehicle. However, the cited references differ from the present invention because they fail to disclose a system including a powered winch, a telescopic hoist arm, and an attachment means on the vehicle for allowing the hoist arm to be pivotally adjusted.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a lifting system which is readily attachable to a vehicle thereby allowing an individual to transport heavy objects without the need of specialized expensive equipment.

It is another object of this invention to provide a lifting system which features a powered winch thereby providing a user with an effortless means to lift and maneuver heavy objects.

It is still another object of the present invention to provide a lifting system which includes a detachable hoist arm mounted to a bottom plate of a vehicle that is capable of lifting heavy objects having a weight of at least 550 pounds.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
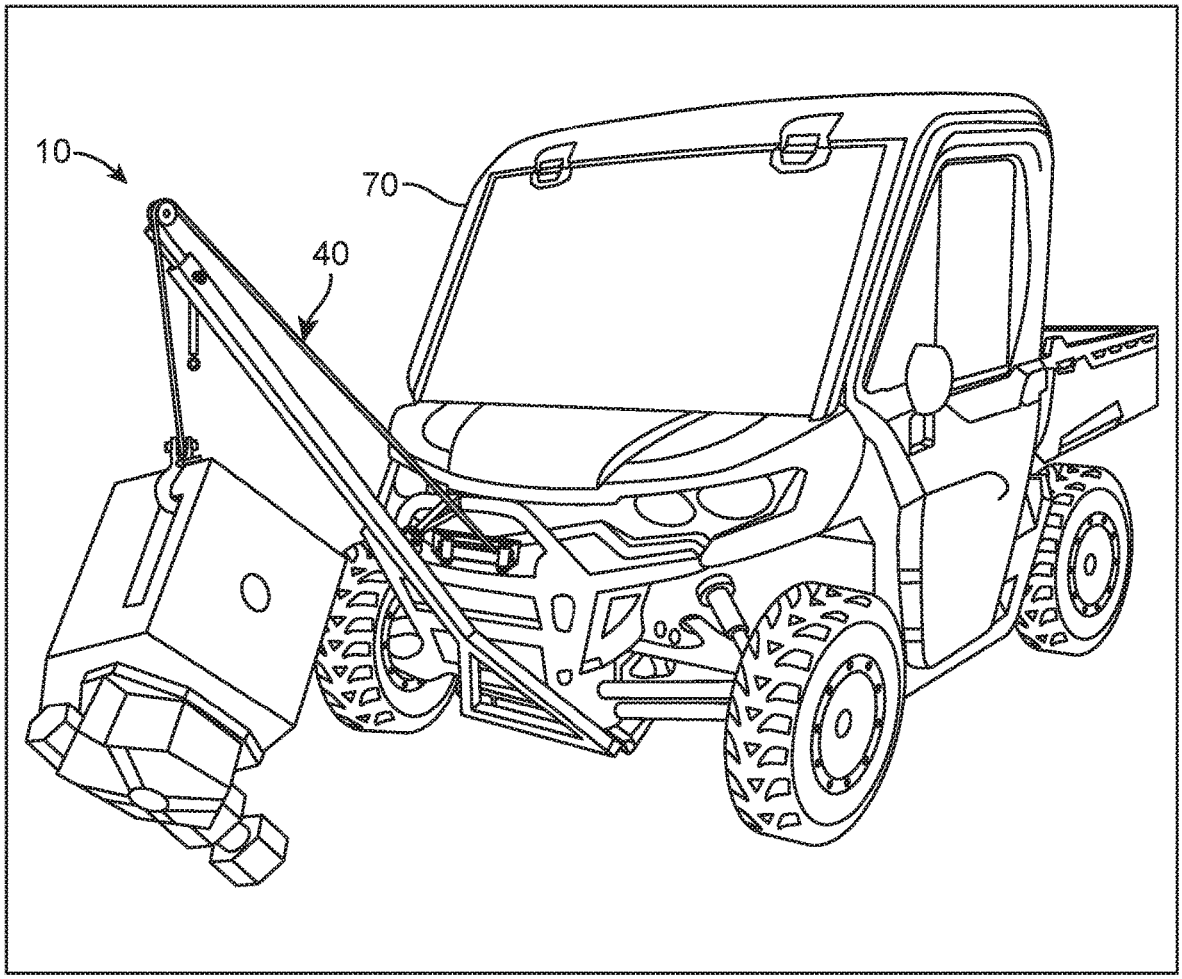
FIG. 1 represents an operational isometric view of lifting system 10 in accordance to an embodiment of the present invention.

Referring now to the drawings, where the present invention is generally referred to with numeral 10, it can be observed a lifting system 10 attachable to a vehicle 70 which basically includes an attachment assembly 20, a hoist arm assembly 40, and a winch assembly 60.

Figure 2:
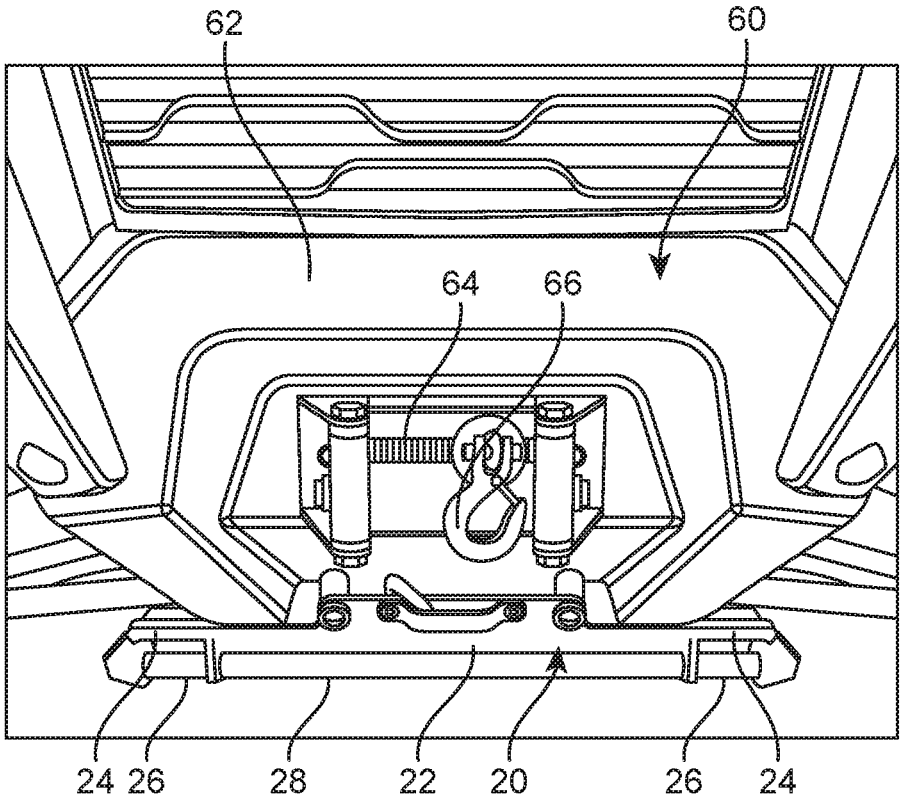
FIG. 2 shows a front perspective view of attachment assembly 20 and winch assembly 60 mounted on a vehicle 70 in accordance to an embodiment of the present invention.
Figure 3:
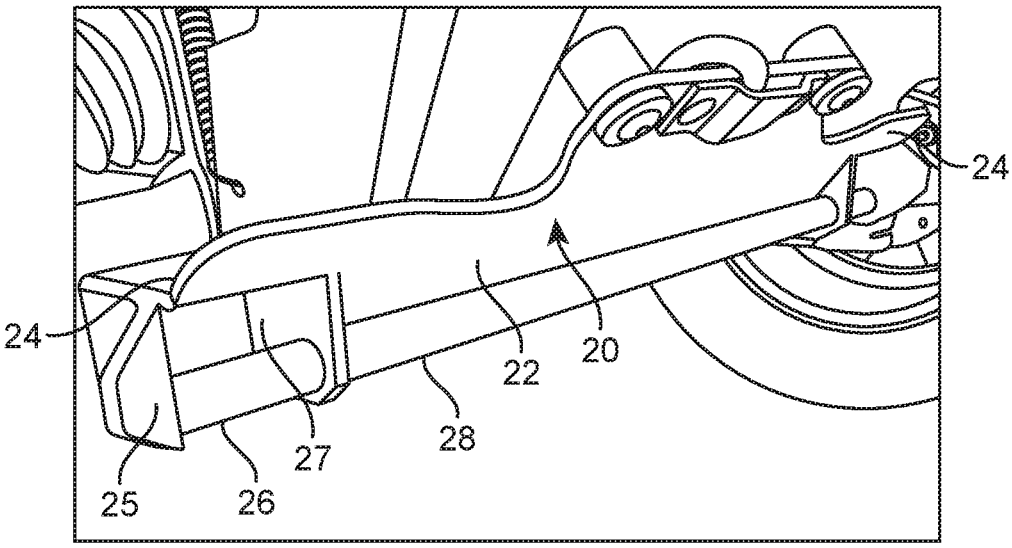
FIG. 3 illustrates a side perspective view of attachment assembly 20 mounted beneath vehicle 70 in accordance to an embodiment of the present invention.

Attachment assembly 20 includes a plate 22 which may be accurately observed in FIGS. 2 and 3 of the provided drawings. In the present embodiment, plate 22 is provided as a metal attachment plate that is mounted to a vehicle 70 to aid in receiving hoist arm assembly 40. As observed in FIG. 4, plate 22 is mounted to a bottom end of vehicle 70 and is further located beneath winch assembly 60. Plate 22 may be mounted through fasteners which are inserted through the plate and attached to the vehicle 70. Other embodiments may feature a plate 22 provided as integral to vehicle 70. In one embodiment, as observed in the figures, vehicle 70 is an all-terrain vehicle having a bumper guard on a front end and specialized tires which allow the vehicle to traverse across harsh terrains. It should be understood that other types of vehicles such as pick-up trucks or cars may be implemented into the present system. Plate 22 includes at least one receiving section 24. In one implementation, at least two receiving sections 24 are implemented on plate 22. FIG. 2 observes two receiving sections 24 located on opposite side ends of plate 22. Other embodiments of the present invention may feature more than two receiving sections 24 for plate 22. However, a preferred embodiment includes two receiving sections 24 to support the hoist arm assembly 40 when mounted thereon. Furthermore, receiving sections 24 are provided as an integral component to the plate and are made of the same metal material that is used for plate 22.

A clear depiction of receiving section 24 may be observed in FIG. 3 of the provided drawings. Receiving section 24 includes sidewalls 25 which includes top sidewall, a rear sidewall, and lateral sidewalls. Sidewalls 25 are integrally joined together to form a housing. Furthermore, a receiving member 26 is mounted to the within the housing. In the present embodiment, receiving member 26 is a cylindrical metallic rod structure which is in abutting engagement with lateral sidewalls of the receiving section 24. In one implementation, lateral sidewalls of sidewalls 25 are provided as being perpendicular to the receiving member. The combination of sidewalls 25 and receiving member 26 form a slot 27. Slot 27 will be utilized to receive hoist arm assembly 40 as will be later described in the detailed description. Attachment assembly 20 further includes a support member 28 which extends across receiving sections 24 in the present embodiment of the invention. FIGS. 2 and 3 observe support member 28 being a metallic rod structure which extend across the plate 22. In the present embodiment, support member 28 is in abutting engagement with an inner side of the lateral sides of sidewalls 25. Support member 28 provides structural reinforcement to the integrity of the plate 22 to properly support hoist arm assembly 40 when received therein.

Figure 4:
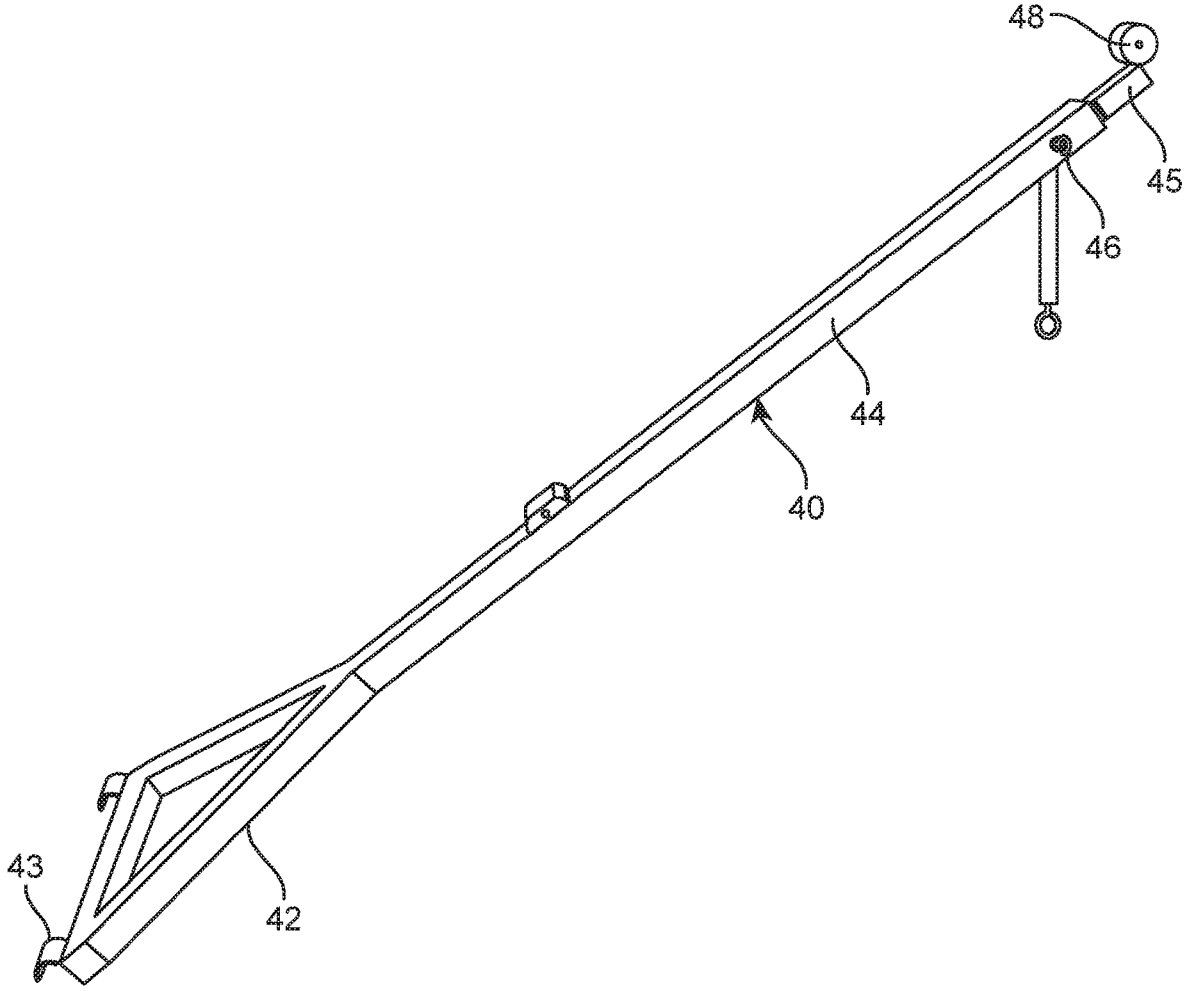
FIG. 4 is a representation of an isometric view of hoist arm assembly 40 in accordance to an embodiment of the present invention.
Figure 5:
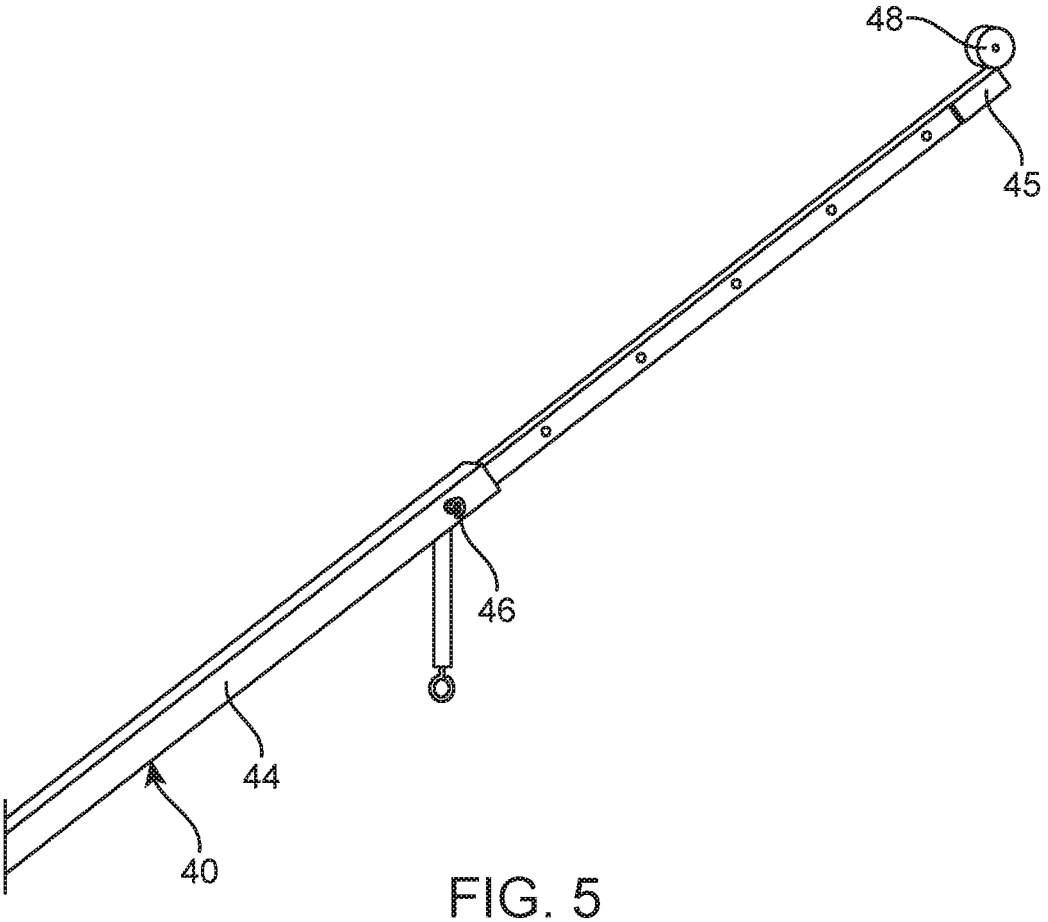
FIG. 5 illustrates an enlarged view of inner arm 45 being extended from outer arm 44 and retained by pin and hole mechanism 46 in accordance to an embodiment of the present invention.
Figure 6:
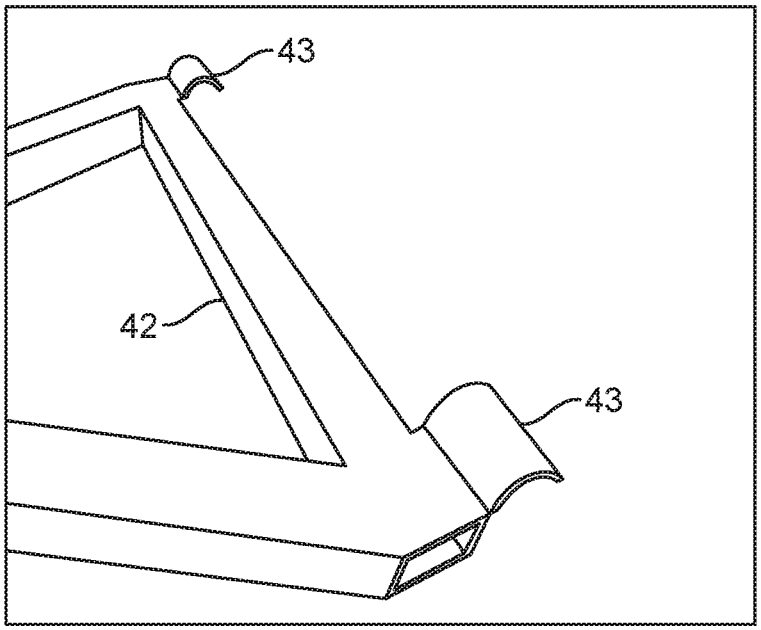
FIG. 6 shows an enlarged perspective view of base 42 and mounting members 43 of hoist arm assembly 40 in accordance to an embodiment of the present invention.

Hoist arm assembly 40 may be properly observed in FIGS. 4 and 5 of the provided drawings. Hoist arm assembly 40 includes a base 42 having a triangular frame with an inner triangular void. In the present embodiment, base 42 is made of a metal material. Base 42 includes a bottom side which includes mounting members 43 which protrude outwardly from the bottom side. It can be observed, that mounting members 43 have several types of shape that are used to be communicable engaged with attachment assembly 20. In one embodiment, mounting members 43 include a convex or semi-circular shape. Other embodiments may also feature a U-shaped member or scooped member. C-shaped members may also be used for mounting members 43. It is pertinent to the present invention that mounting members 43 have an arched configuration.

Figure 7:
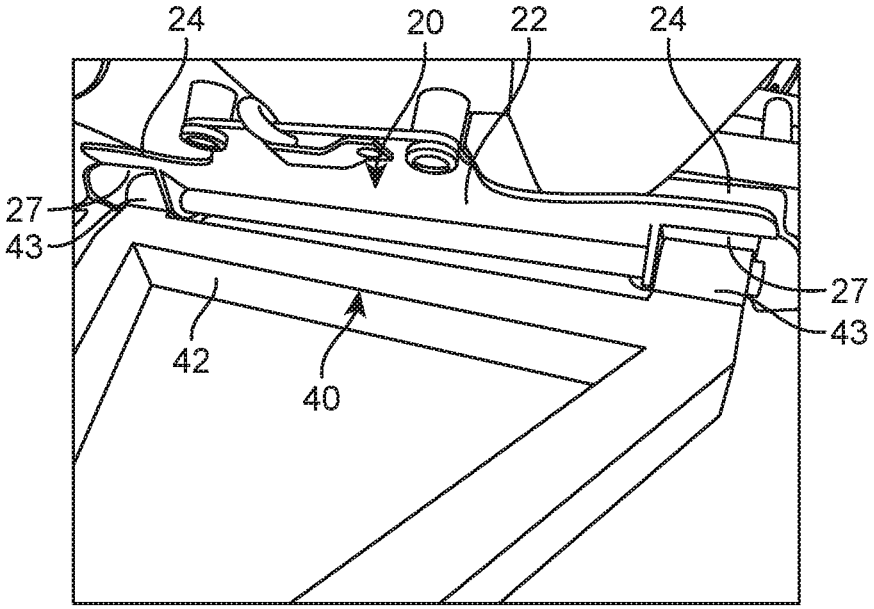
FIG. 7 illustrates an enlarged perspective view of attachment assembly 20 having hoist arm assembly 40 mounted thereon in accordance to an embodiment of the present invention.
Figure 8:
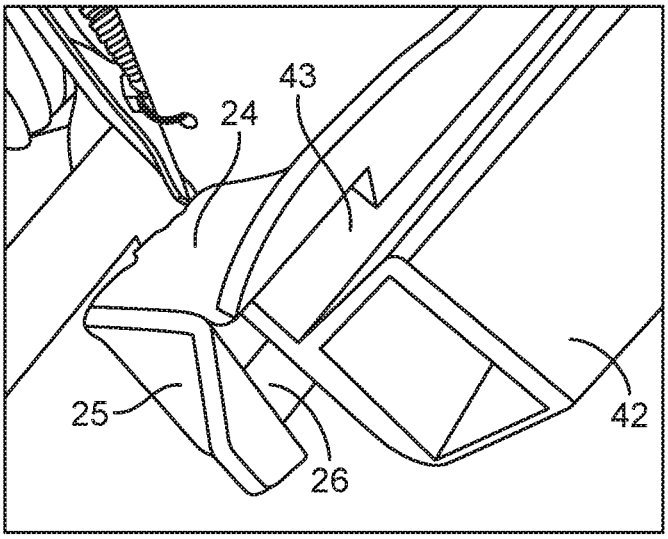
FIG. 8 represents another enlarged perspective view of attachment assembly 20 having hoist arm assembly 40 mounted thereon in accordance to an embodiment of the present invention.

FIGS. 7 and 8 depict hoist arm assembly 40 being attached to attachment assembly 20. It can be observed that the mounting members 43 are received by the receiving member 26 and effectively inserted within slot 27 of the attachment assembly. As a result, a secure mounting connection is formed between the hoist arm assembly 40 and the attachment assembly 20. The combination of the curved structure of mounting members 43 and the cylindrical shape of the receiving member 26 allow for the hoist arm to be pivotally adjusted when mounted to the attachment assembly 20. This will provide a user with flexibility with regards to the angle at which they desire to hoist the hoist arm.

Hoist arm assembly 40 further includes an outer arm 44 which extends from the pointed end of base 42. In the present embodiment, outer arm 44 has a rectangular configuration and is made of a metal material. Outer arm 44 is a hollow structure which includes inner arm 45 translated therein. Inner arm 45 may be translated outwardly from outer arm 44 in order to increase a length of the hoist arm. It should be understood, that inner arm 45 is provided as having a shape which will cooperate with the interior of outer arm 44. Hoist arm assembly 40 further includes a pin 46 which is inserted within an opening of outer arm 44 and is communicably inserted through inner arm 45. As a result, a securing means is provided for the inner arm 45 and the outer arm 44. A user may translate inner arm 45 to a desired length and then insert pin 46 to effectively lock the hoist arm to a desired length. The provided structure forms a telescopic hoist for hoist assembly 40. The telescopic nature of the hoist arm assembly 40 will allow for a user to more effectively mount and carry heavy objects using the vehicle 70. In one embodiment, the system 10 is capable of supporting at least 550 pounds of weight.

Figure 9:
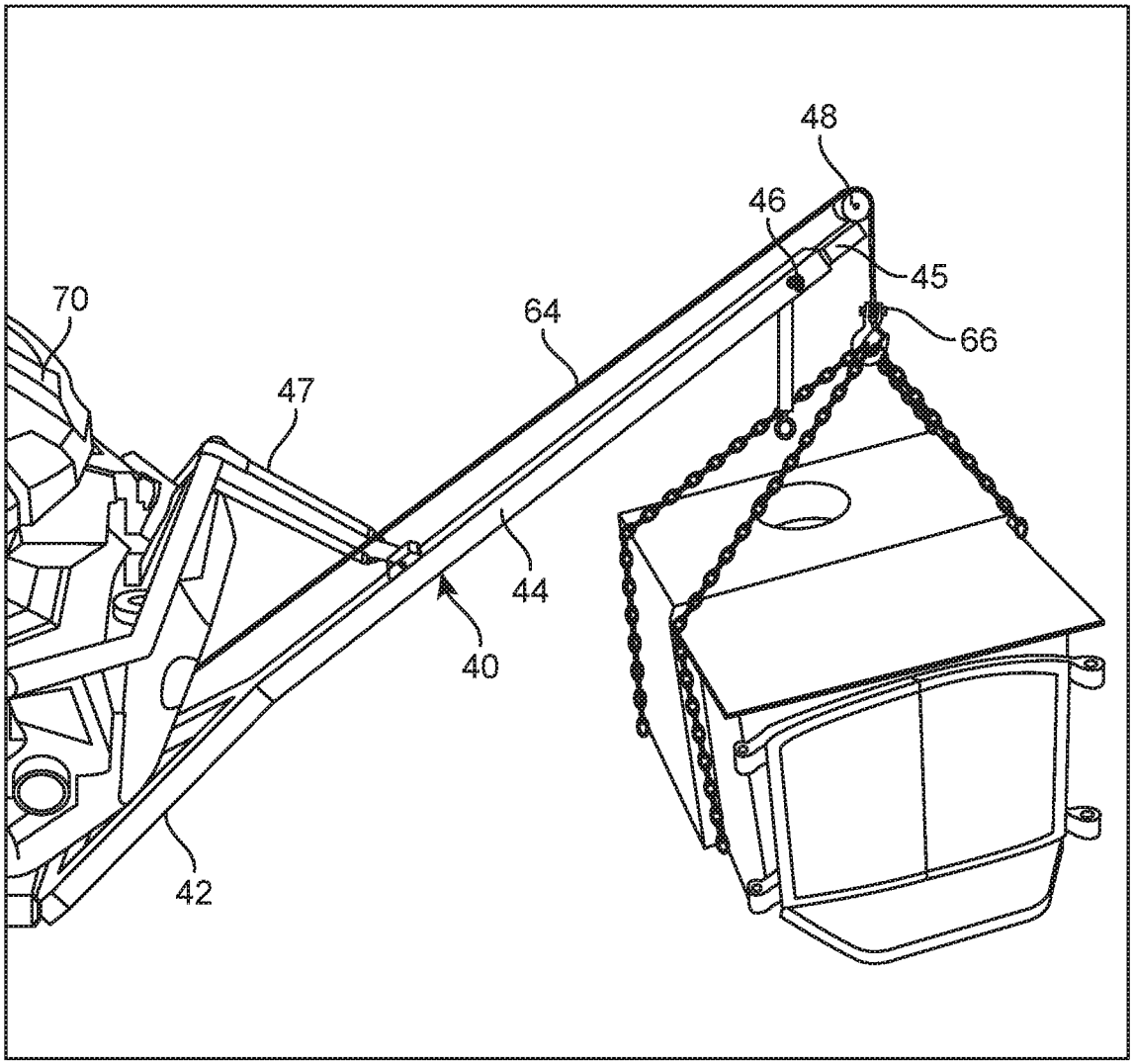
FIG. 9 shows a perspective operational side view of lifting system 10 depicting hoist arm assembly 20 lifting a heavy object in accordance to an embodiment of the present invention.

Hoist arm assembly 40 further includes a strap 47 which is located on a top portion of outer arm 44. In the present embodiment, strap 47 is attached to the outer arm 44 through hooks that are received in openings of the top portion of the outer arm 44. Strap 47 may be provided as an adjustable cloth strap and provides further structural support to the hoist arm assembly 40 when coupled to vehicle 70. In one implementation, observed in FIG. 9 of the drawings, strap 47 is wrapped around and mounted to a bumper frame located on a front end of vehicle 70. In the present embodiment, strap 47 will aid in supporting the weight that is being carried by the system 10. Hoist arm assembly 40 further includes a pulley 48 which is mounted to a top distal end of inner arm 45. Pulley 48 will be used to support the winch line that will be provided by winch assembly 60. In the present embodiment, pulley 48 may be mounted using known mechanisms such as fasteners, welding, and the like.

Winch assembly 60 may be properly observed in FIG. 2 of the provided drawings. Winch assembly 60 includes a housing 62 which may be provided as an integral component of the vehicle 70. As observed, housing 62 is located near a bottom end of the vehicle. Having the winch assembly 60 located near the bottom end of the vehicle will aid the system 10 when carrying a load. Winch assembly 60 further includes a winch line 64 which is stored within housing 62. In one embodiment, winch line 64 is made of a material that is strong enough to support heavy loads of weight. A hook 66 is further attached to the winch line 64. In one embodiment hook 66 includes a latch that will open and closed to allow for the member to be mounted to a chain or a load to be carried. The winch line 64 is then extended over a top end of the outer arm 44 as observed in FIG. 9. Winch line 64 is further received by the pulley 48 and then mounted to a chain or a load for carrying. In one implementation, winch assembly 60 is provided as a powered winch that is powered and controlled within vehicle 70.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A lifting system for a vehicle, comprising:

a) an attachment assembly including a plate having receiving sections on opposing sides, wherein said receiving sections each include sidewalls and a receiving member to form a slot, the receiving member has a cylindrical shape, said plate is mounted to a bottom end of an all-terrain vehicle, said all-terrain vehicle including a bumper frame located on a front side thereof;

b) a hoist arm assembly including a base and a hoist arm, wherein said hoist arm is a telescopic hoist arm having an outer arm and an inner arm, said inner arm includes openings that transversally cross the inner arm, the openings are separated from each other a predetermined distance, the openings cover a length of said inner arm, wherein said inner arm is translated within said outer arm and secured with a pin, said pin is inserted through an opening located at a top distal end of the outer arm and through an opening from the openings that are located along said inner arm, wherein said base includes a bottom side end with protruding mounting members, wherein said mounting members are inserted within said receiving sections and received by said receiving member thereby allowing said hoist arm to be pivotally adjusted, said base has three cuboid bars united at distal ends configuring a triangular base, wherein each cuboid bar has a same length, said outer arm extends from a top corner of said triangular base, said mounting members protrude from distal ends of a horizontal bar from the triangular base which is opposite to said top corner, said mounting members each have an arched configuration each of said mounting members has a concave shape which conform with an exterior surface of the receiving member; and c) a powered winch assembly including a housing which encloses a winch line having a hook mounted thereon, wherein said winch line extends over a top end of said hoist arm, said powered winch assembly is located on said front end.

2. The lifting system of claim 1 wherein said sidewalls of said receiving section includes a top sidewall, a rear sidewall, and lateral sidewalls.

3. The lifting system of claim 2 wherein said receiving member extends across said lateral sidewalls.

4. The lifting system of claim 1 wherein said attachment assembly includes a support member extending across said plate and communicably mounted to said receiving sections, said support member has an elongated cylindrical shape that is located between each slot of said receiving section, said support member has a diameter that is the same as a diameter of said receiving member.

5. The lifting system of claim 1 wherein said inner arm further includes a pulley at a topmost distal end.

6. The lifting system of claim 1 wherein said hoist arm assembly further includes a strap coupled to a bumper frame of said vehicle and an outer portion of said outer arm.

7. A lifting system for a vehicle, consisting of:

a) an all-terrain vehicle having a bumper frame;

b) an attachment assembly including a plate mounted to a bottom end of said all-terrain vehicle, wherein said plate includes fasteners to mount said plate to said bottom end, wherein said plate includes two receiving sections on opposing sides of said plate each having sidewalls and a receiving member, wherein said sidewalls include a top sidewall, a rear sidewall, and lateral sidewalls, wherein said receiving member is in abutting engagement with said lateral sidewalls to form a slot, said plate further including a support member which extends between said two receiving sections, said support member has an elongated cylindrical shape that is located between each slot of said receiving section, said support member has a diameter that is the same as a diameter of said receiving member;

c) a hoist arm assembly including a base and a hoist arm, said base has three cuboid bars united at distal ends configuring a triangular base, each cuboid bar has a same length, said base further including two mounting members protruding from a bottom edge of said base, wherein said two mounting members are received by said two receiving sections, wherein said two mounting members are coupled to each respective receiving member thereby allowing said hoist arm to be pivotally adjustable, said hoist arm including an outer arm and an inner arm translated within said outer arm, said inner arm includes openings that transversally cross the inner arm, the openings are separated from each other a predetermined distance, the openings cover a length of said inner arm, said inner arm coupled to said outer arm through a pin which is inserted into a said openings to define a predetermined length, wherein said hoist arm assembly also includes a strap coupling said bumper frame and an outer portion of said outer arm, said inner arm also including a pulley at a top most distal end, said outer arm extends from a top corner of said triangular base, said two mounting members protrude from distal ends of a horizontal bar from the triangular base which is opposite to said top corner, said two mounting members have an arched configuration wherein the two mounting members have a concave shape which conform with an exterior surface of each respective receiving member, thereby permitting the two mounting members to rotate along each respective mounting members; and d) a powered winch assembly including a housing disposed on a front side of said all-terrain vehicle which encloses a winch line having a hook mounted thereon, wherein said winch line extends over a top end of said hoist arm.

* * * * *